US008556379B2

(12) United States Patent
Naruse et al.

(10) Patent No.: US 8,556,379 B2
(45) Date of Patent: Oct. 15, 2013

(54) IMAGE FORMING APPARATUS

(75) Inventors: Shinichiro Naruse, Kanagawa (JP); Ichiro Komuro, Kanagawa (JP); Mamoru Yorimoto, Tokyo (JP); Soichi Saiga, Tokyo (JP); Ryusuke Mase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 44 days.

(21) Appl. No.: 12/961,018

(22) Filed: Dec. 6, 2010

(65) Prior Publication Data

US 2011/0134187 A1 Jun. 9, 2011

(30) Foreign Application Priority Data

Dec. 7, 2009 (JP) ..... 2009-278023

(51) Int. Cl.
*B41J 23/00* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 5,359,357 | A * | 10/1994 | Takagi et al. | 347/49 |
| 6,164,755 | A * | 12/2000 | Yamamoto | 347/37 |
| 6,357,849 | B2 * | 3/2002 | Takizawa et al. | 347/19 |
| 2010/0295897 | A1 | 11/2010 | Naruse et al. | |

FOREIGN PATENT DOCUMENTS

| | | |
|---|---|---|
| JP | 9-76481 | 3/1997 |
| JP | 9-240097 | 9/1997 |
| JP | 2785031 | 5/1998 |
| JP | 2002-127446 | 5/2002 |
| JP | 3332764 | 7/2002 |
| JP | 2003-312080 | 11/2003 |

OTHER PUBLICATIONS

Japanese official action dated Jul. 16, 2013 in corresponding Japanese patent application No. 2009-278023.

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

An image forming apparatus including a first carriage having a recording head that ejects black liquid droplets and is movable in a main scanning direction and a second carriage having a recording head that ejects color liquid droplets and is detachably attachable to the first carriage within a scanning range of the first carriage in the main scanning direction. The second carriage when attached to the first carriage is movable in the main scanning direction together with the first carriage. Attachment and detachment of the second carriage to and from the first carriage are performed based on a predetermined reference position of the first carriage in the main scanning direction.

6 Claims, 11 Drawing Sheets

IMAGE FORMING APPARATUS

BACKGROUND

1. Technical Field

This disclosure relates generally to an image forming apparatus, and more particularly to an image forming apparatus using a recording head including a liquid ejection head that ejects liquid droplets.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head that ejects droplets of a recording liquid such as ink onto a sheet of a recording medium while the sheet is conveyed to form an image on the sheet.

Examples of the inkjet recording device include a serial-type image forming apparatus, in which the recording head ejects liquid droplets while moving in a main scanning direction to form an image on the sheet as the sheet is moved in a sub-scanning direction perpendicular to the main scanning direction, and a line-type image forming apparatus equipped with a line-type recording head that ejects liquid droplets and does so without moving to form an image on the sheet as the sheet is moved in the sub-scanning direction.

A maintenance mechanism that maintains and recovers performance of the recording head is essential for the image forming apparatus employing the liquid ejection recording method. One of the functions of the maintenance mechanism is to discharge bubbles, foreign substances, coagulated ink, and so forth present in the recording head through nozzles in the recording head in order to prevent irregular ejection of the ink from the nozzles in the recording head.

In addition, a full-color image forming apparatus that forms full-color images using the liquid ejection recording method generally includes two separate recording heads, that is, a recording head that ejects black ink droplets (hereinafter referred to as the first recording head) and a recording head that ejects color ink droplets (hereinafter referred to as the second recording head). In such a full-color image forming apparatus, not only black ink but also color ink is ejected for maintenance of the recording heads even when monochrome printing is performed using only the first recording head, causing a waste of color ink and a concomitant cost increase.

In order to solve this problem, various techniques have been proposed. In one example, an image forming apparatus includes a scanning-type carrier which is moved reciprocally back and forth by a drive force; a first carriage that ejects black ink droplets and a second carriage that ejects color ink droplets, each detachably attachable to the carrier; a detector that detects that the carriages attached to the carrier pass through a certain reference position in a direction of movement of the carrier; and a control unit that controls movement of the carrier using as a reference a time when the detector detects the carriages.

Another example of an image forming apparatus includes a first carriage that ejects black ink droplets, a second carriage that ejects color ink droplets, and a scanning element serving as a carrier. Each of the first and second carriages and the carrier has a shielding plate. An interval between the shielding plates respectively provided to the first carriage and the carrier when the first carriage and the carrier are coupled together is different from an interval between the shielding plates respectively provided to the second carriage and the carrier when the second carriage and the carrier are coupled together in a direction of movement of the carrier. Accordingly, which carriage is coupled to the carrier is determined based on a timing detected by an optical sensor that detects movement of the shielding plates.

In yet another approach, an image forming apparatus includes a first carrier to which a first image forming head is replaceably installed, a second carrier to which a second image forming head is replaceably installed, and a connector separatably connectable to each of the first and second carriers. The image forming apparatus further includes a scanner that moves one or both of the first and second carriers connected to the connector in a main scanning direction. The first and second image forming heads eject liquid droplets of the same colors.

However, in the above-described configurations in which the carriages are connected to each other with the carrier or the scanner serving as an intermediate member, the accuracy with which the relative positions of the carriages are secured is decreased due to the use of the intermediate body, thus degrading image quality.

SUMMARY

In this disclosure, a novel image forming apparatus including first and second carriages separatably dockable with each other to move the first and second carriages together is provided to achieve higher quality images by accurately setting the relative positions of the first and second carriages docked together.

In one illustrative embodiment, an image forming apparatus includes a first carriage having a recording head that ejects black liquid droplets and is movable in a main scanning direction and a second carriage having a recording head that ejects color liquid droplets and is detachably attachable to the first carriage within a scanning range of the first carriage in the main scanning direction. The second carriage when attached to the first carriage is movable in the main scanning direction together with the first carriage. Attachment and detachment of the second carriage to and from the first carriage are performed based on a predetermined reference position of the first carriage in the main scanning direction.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
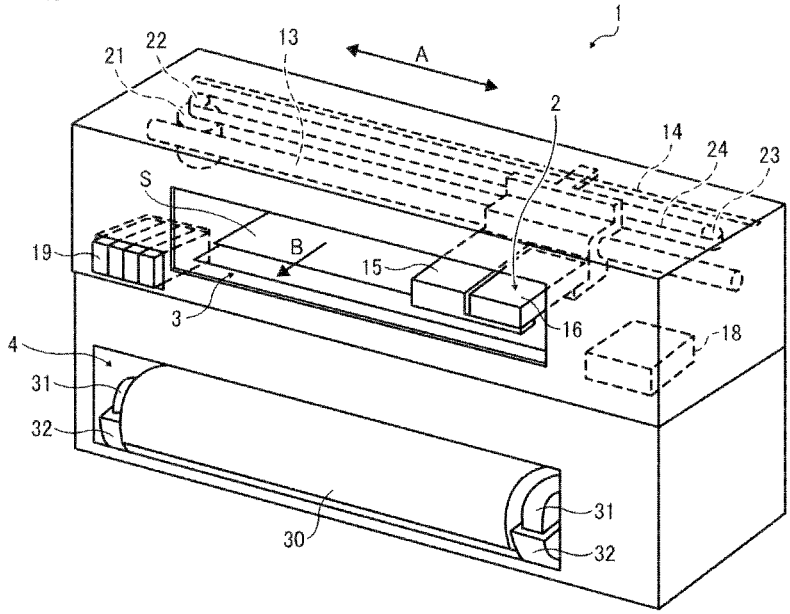
FIG. 1 is a perspective view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns. In addition, ink includes any material which is a liquid when ejected from the recording head, such as a DNA sample, a resist material, and a pattern material. Further, an image formed on the recording medium is not limited to a flat image, but also includes an image formed on a three-dimensional object, a three-dimensional image, and so forth.

Figure 2:
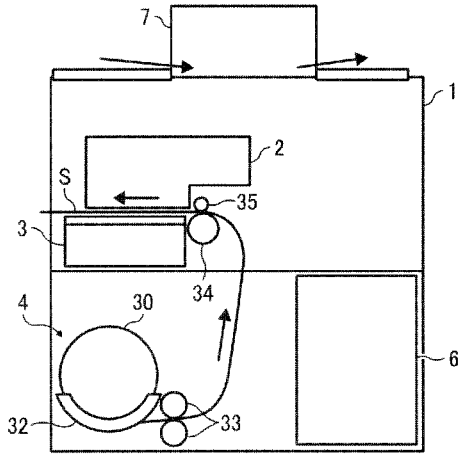
FIG. 2 is a vertical cross-sectional view illustrating the configuration of the image forming apparatus illustrated in FIG. 1.
Figure 3:
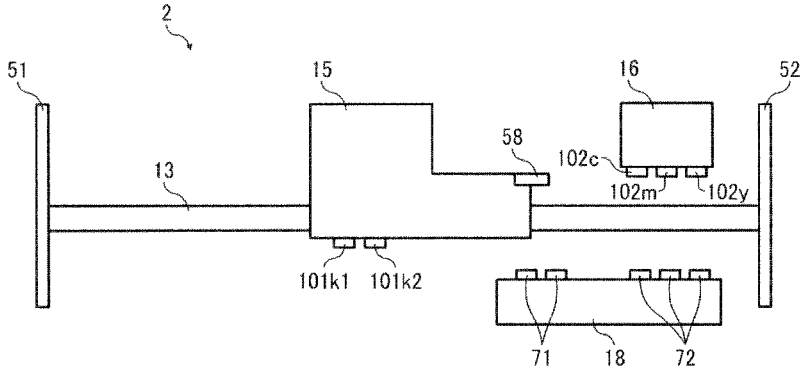
FIG. 3 is a front view illustrating a configuration of an image forming unit of the image forming apparatus illustrated in FIG. 1.

A description is now given of a configuration and operation of an inkjet recording device serving as an image forming apparatus 1 according to illustrative embodiments with reference to FIGS. 1 to 3. FIG. 1 is a perspective view illustrating an example of a configuration of the image forming apparatus 1. FIG. 2 is a vertical cross-sectional view illustrating the configuration of the image forming apparatus 1. FIG. 3 is a front view illustrating a configuration of an image forming unit 2 of the image forming apparatus 1.

The image forming apparatus 1 is a serial-type inkjet recording device, and includes the image forming unit 2, a sheet conveyance unit 3, a sheet roll storage 4, an electrical substrate storage 6, an image reading unit 7 provided at the top thereof, and so forth. It is to be noted that the image reading unit 7 is omitted in FIG. 1 for ease of illustration.

In the image forming unit 2, a guide rod 13 and a guide rail 14 are extended between lateral plates 51 and 52, and a first carriage 15 that ejects black ink droplets is slidably held by the guide rod 13 and the guide rail 14 in a direction indicated by a double-headed arrow A in FIG. 1 (hereinafter referred to as the main scanning direction). A second carriage 16 that ejects color ink droplets can be docked with and separated from the first carriage 15. It is to be noted that FIG. 1 illustrates a state in which the first and second carriages 15 and 16 are docked together, and FIG. 3 illustrates a state in which the first and second carriages 15 and 16 are separated from each other.

A main scanning mechanism that moves the first carriage 15 reciprocally in the main scanning direction includes a drive motor 21 positioned at one end of the image forming apparatus 1 in the main scanning direction, a drive pulley 22 driven by the drive motor 21, a driven pulley 23 provided at the other end of the image forming apparatus 1 in the main scanning direction, and a belt member 24 wound around the drive pulley 22 and the driven pulley 23. A tension spring, not shown, applies tension to the driven pulley 23 to separate the driven pulley 23 from the drive pulley 22. A part of the belt member 24 is fixed to a mount provided to a back surface of the first carriage 15 to guide the first carriage 15 in the main scanning direction.

An encoder sheet, not shown, is provided along the main scanning direction in order to detect a main scanning position of the first carriage 15. The encoder sheet is read by an encoder sensor, not shown, provided to the first carriage 15.

The first carriage 15 has a main scanning range through which it scans, and within this range is a recording range. A sheet S fed from a sheet roll 30 is intermittently conveyed to the recording range by the sheet conveyance unit 3 in a direction perpendicular to the main scanning direction indicated by an arrow B in FIG. 1 (hereinafter referred to as the sub-scanning direction).

An ink cartridge 19 that stores ink of a specific color, that is, yellow (Y), cyan (C), magenta (M), or black (K), to be supplied to sub-tanks included in recording heads provided to the first and second carriages 15 and 16, is detachably attached to the image forming apparatus 1 at the one end of the image forming apparatus 1 in the main scanning direction, that is, a portion outside the main scanning range of the first carriage 15. A maintenance mechanism 18 that performs maintenance and recovery of the recording heads is provided at the other end of the image forming apparatus 1 in the main scanning direction within the main scanning range of the first carriage 15.

The sheet roll 30 is set in the sheet roll storage 4 serving as a sheet feed unit. The sheet roll 30 having different widths can be set in the sheet roll storage 4. Flanges 31 are attached to both ends of a paper core of the sheet roll 30 and are placed on flange bearings 32, respectively. Support rollers, not shown, are provided to the flange bearings 32 to contact outer circumferential surfaces of the flanges 31, respectively, thereby rotating the flanges 31 to feed the sheet S from the sheet roll 30.

The sheet S fed from the sheet roll 30 set in the sheet roll storage 4 is conveyed by conveyance members such as a pair of rollers 33, a drive roller 34, and a driven roller 35 from the back to the front of the image forming apparatus 1 to reach the recording range. In monochrome printing, the first carriage 15 is moved reciprocally in the main scanning direction, and the recording heads of the first carriage 15 are driven to eject black ink droplets onto the sheet S based on image data while the sheet S is intermittently conveyed in the sub-scanning direction. By contrast, in full-color printing, the first and second carriages 15 and 16 are docked together, and the recording heads of the first and second carriages 15 and 16 are together driven to eject ink droplets of the specified color onto the sheet S based on image data. Accordingly, a desired image is formed on the sheet S. The sheet S having the image thereon is then cut to a predetermined length and is discharged to a discharge tray, not shown, provided to the front of the image forming apparatus 1.

Figure 4:
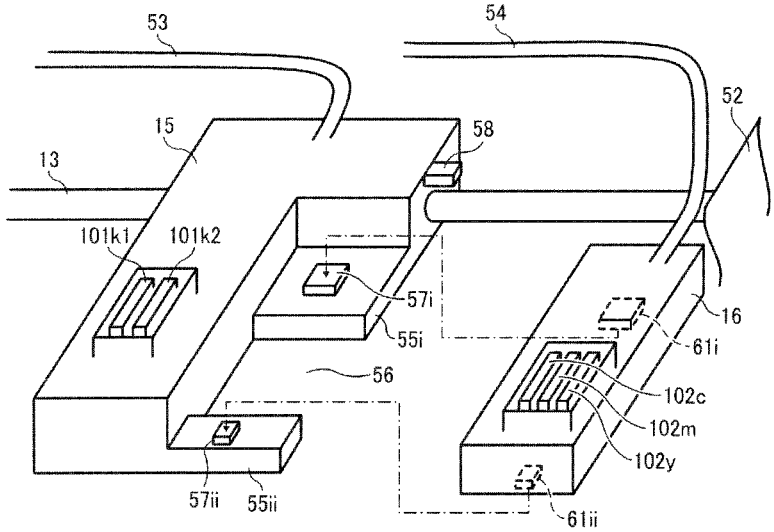
FIG. 4 is a perspective view illustrating an example of a configuration of first and second carriages separated from each other according to illustrative embodiments.
Figure 5:
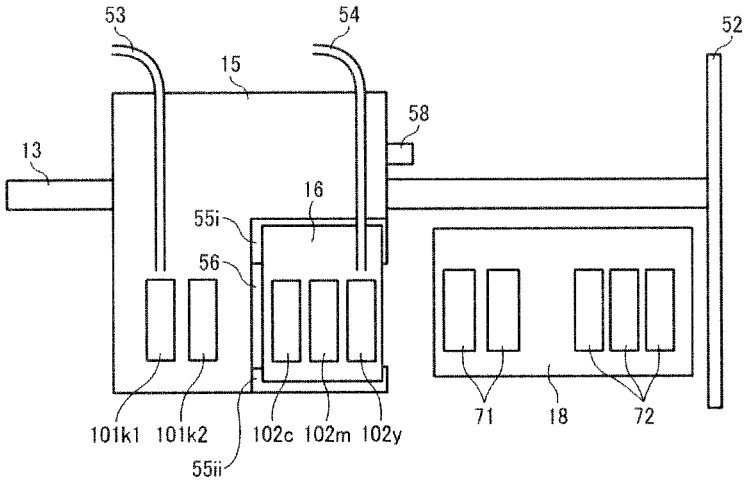
FIG. 5 is a top view illustrating an example of a configuration of the first and second carriages docked together according to illustrative embodiments.
Figure 6:
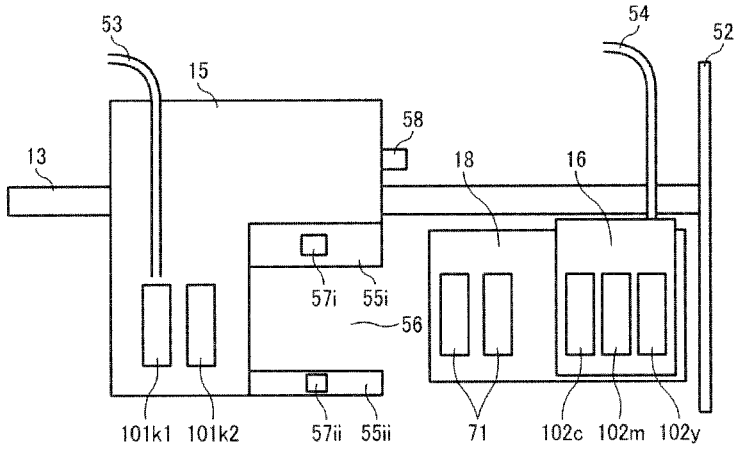
FIG. 6 is a top view illustrating the example of the configuration of the first and second carriages separated from each other.

A description is now given of a configuration of each of the first and second carriages 15 and 16 according to illustrative embodiments with reference to FIGS. 4 to 6. FIG. 4 is a perspective view illustrating an example of a configuration of the first and second carriages 15 and 16 separated from each other according to illustrative embodiments. FIG. 5 is a top view illustrating the first and second carriages 15 and 16 docked together. FIG. 6 is a top view illustrating the first and second carriages 15 and 16 separated from each other.

The first carriage 15 includes first and second recording heads 101*k*1 and 101*k*2 (hereinafter collectively referred to as recording heads 101) each including a liquid ejection head that ejects black ink droplets. The first carriage 15 is moved reciprocally in the main scanning direction along the guide rod 13 by the carriage scanning mechanism. Black ink is supplied from the ink cartridge 19 provided to the image forming apparatus 1 to the sub-tanks integrally formed with the recording heads 101 through a tube 53. Alternatively, replaceable ink cartridges may be attached to the recording heads 101.

The second carriage 16 includes recording heads 102*c*, 102*m*, and 102*y* (hereinafter collectively referred to as recording heads 102), each including a liquid ejection head that ejects ink droplets of a specific color, that is, cyan (C), magenta (M), or yellow (Y). The second carriage 16 is docked with the first carriage 15 to be moved reciprocally in the main scanning direction together with the first carriage 15 by reciprocating movement of the first carriage 15. Ink of the specific color is supplied from the ink cartridge 19 provided to the image forming apparatus 1 to the sub-tanks integrally formed with the recording heads 102 through a tube 54. Alternatively, replaceable ink cartridges may be attached to the recording heads 102.

The first carriage 15 has mounts 55*i* and 55*ii* (hereinafter collectively referred to as mounts 55) to place the second carriage 16 thereon, and a cutout 56 is formed between the mounts 55. When the second carriage 16 is placed on the mounts 55 to be docked with the first carriage 15, the color ink droplets are ejected from the recording heads 102 of the second carriage 16 onto the sheet S through the cutout 56, and caps of the maintenance mechanism 18 to be described in detail later are moved up and down within the cutout 56. The mounts 55 respectively have engaging members 57*i* and 57*ii* (hereinafter collectively referred to as engaging members 57) each separatably engageable with engaging members 61*i* and 61*ii* (hereinafter collectively referred to as engaging members 61) provided to the second carriage 16. Alternatively, a docking mechanism 80 may be used in place of the engaging members 57 and 61 for docking of the second carriage 16 with the first carriage 15.

The first carriage 15 further includes a protrusion 58 that protrudes toward the lateral plate 52 beyond the second carriage 16 when the first carriage 15 is docked with the second carriage 16. The protrusion 58 is used for detecting a reference position of the first carriage 15. Specifically, a position where the protrusion 58 contacts the lateral plate 52 is detected by, for example, detecting a change in a driving current of a main scanning motor, and the first carriage 15 is moved from that position to a direction opposite the lateral plate 52 by a predetermined amount and the resultant position of the first carriage 15 is set as the reference position. A home position of the first carriage 15 can be detected in a manner similar to detection of the reference position of the first carriage 15 as described above, and the home position may be the same as or different from the reference position.

Alternatively, a detection member may be provided to the first carriage 15 in place of the protrusion 58 so that relative positions of the detection member and a reference position provided to the main body of the image forming apparatus 1 are detected to determine the reference position of the first carriage 15. In such a case, the reference position of the first carriage 15 may be determined by, for example, a reference position detector such as a sensor provided to the main body of the image forming apparatus 1, or by matching of a result detected by the encoder sensor that detects the position of the first carriage 15 and a preset reference position.

The maintenance mechanism 18 includes caps 71 that cap the recording heads 101 of the first carriage 15, caps 72 that cap the recording heads 102 of the second carriage 16, a wiper member, not shown, and so forth.

Figure 7:
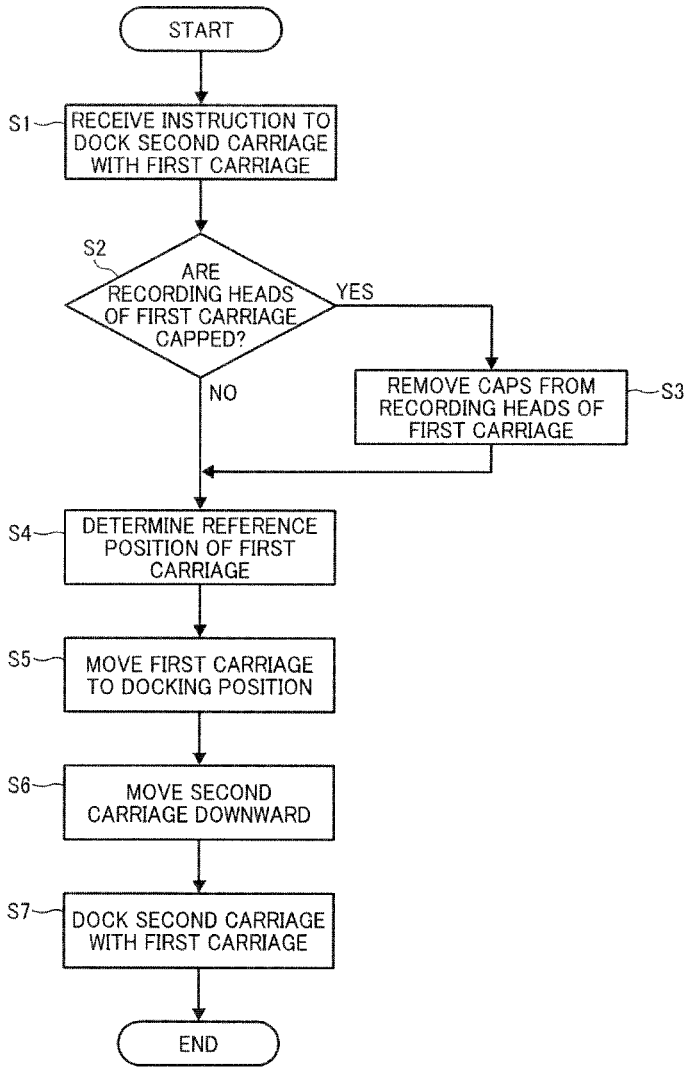
FIG. 7 is a flowchart illustrating steps in a process of docking the second carriage with the first carriage according to illustrative embodiments.

A description is now given of docking of the second carriage 16 with the first carriage 15 with reference to FIG. 7. FIG. 7 is a flowchart illustrating steps in a process of docking the second carriage 16 with the first carriage 15 according to illustrative embodiments.

Upon receiving an instruction to dock the second carriage 16 with the first carriage 15 at step S1, at S2 whether or not the recording heads 101 of the first carriage 15 are capped is confirmed. When the recording heads 101 of the first carriage 15 are capped with the caps 71 (YES at S2), the process proceeds to S3 to remove the caps 71 from the recording heads 101 of the first carriage 15, and then at S4, the reference position of the first carriage 15 is determined. When the recording heads 101 of the first carriage 15 are not capped (NO at S2), the process proceeds directly to S4 so that the reference position of the first carriage 15 is determined. At S5, the first carriage 15 is moved to a docking position (or is left as is at the reference position). At S6, the caps 72 that cap the recording heads 102 of the second carriage 16 are lowered, and then the second carriage 16 is lowered. Alternatively, the caps 72 and the second carriage 16 may be lowered together. At S7, the second carriage 16 is placed on the mounts 55 of the first carriage 15 so that the second carriage 16 is docked with the first carriage 15.

Figure 8A:
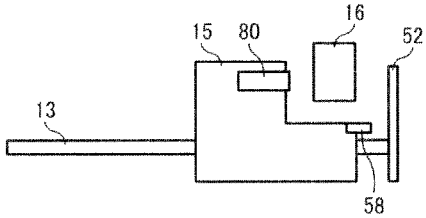
FIGS. 8A to 8E are front views respectively illustrating stages in the process of docking the second carriage with the first carriage.
Figure 8B:
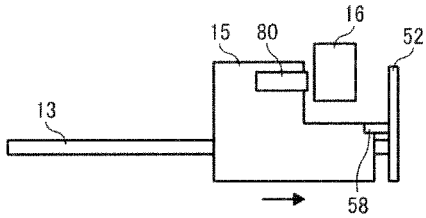
Figure 8C:
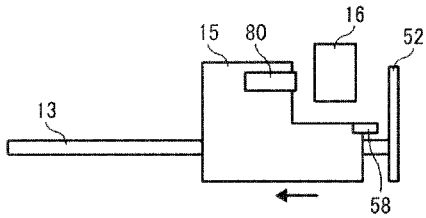
Figure 8D:
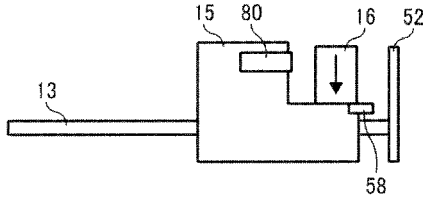
Figure 8E:
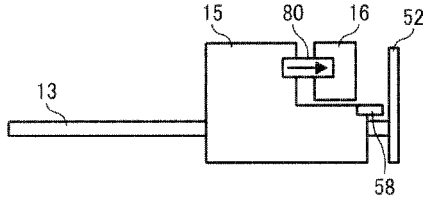

FIGS. 8A to 8E are front views respectively illustrating stages in the process of docking the second carriage 16 with the first carriage 15. It is to be noted that, in this case, the docking mechanism 80 is used in place of the engaging members 57 and 61 for docking of the second carriage 16 with the first carriage 15 in FIGS. 8A to 8E. When docking of the second carriage 16 with the first carriage 15 is requested in the state illustrated in FIG. 8A, the first carriage 15 is moved toward the lateral plate 52 and the protrusion 58 contacts the lateral plate 52 as illustrated in FIG. 8B to determine the reference position of the first carriage 15. Alternatively, the reference position of the first carriage 15 may be determined by the different methods described previously. Next, the first carriage 15 is moved to the docking position as illustrated in FIG. 8C and the caps 72 that cap the recording heads 102 of the second carriage 16 are lowered. Thereafter, the second carriage 16 is lowered as illustrated in FIG. 8D, and the second carriage 16 is placed on the mounts 55 of the first carriage 15 so that the first and second carriages 15 and 16 are docked together by the docking mechanism 80 as illustrated in FIG. 8E.

Figure 9:
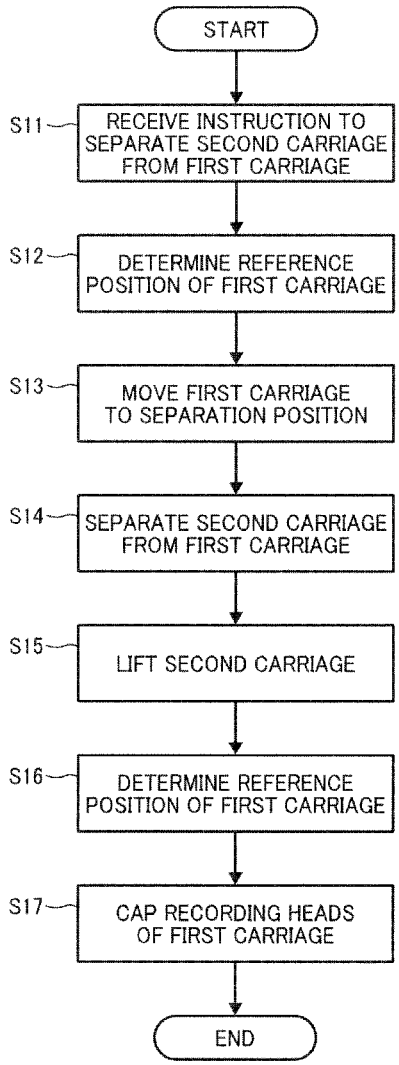
FIG. 9 is a flowchart illustrating steps in a process of separating the second carriage from the first carriage according to illustrative embodiments.

A description is now given of separation of the second carriage 16 from the first carriage 15 with reference to FIG. 9. FIG. 9 is a flowchart illustrating steps in a process of separating the second carriage 16 from the first carriage 15 according to illustrative embodiments.

Upon receiving an instruction to separate the second carriage 16 from the first carriage 15 at step S11, at S12 the reference position of the first carriage 15 with which the second carriage 16 is docked is determined. At S13, the first carriage 15 is moved to a separation position, and at S14 separation of the second carriage 16 from the first carriage 15 is performed. At S15, the second carriage 16 is lifted and the recording heads 102 of the second carriage 16 are capped with the caps 72 to complete separation of the second carriage 16 from the first carriage 15. Thereafter, at S16 the reference position of the first carriage 15 is determined again to move the first carriage 15 to a capping position. At S17, the recording heads 101 of the first carriage 15 are capped with the caps 71. It is to be noted that determination of the reference position of the first carriage 15 after the second carriage 16 is separated from the first carriage 15 may or may not be performed depending on the situation at that time.

Figure 10A:
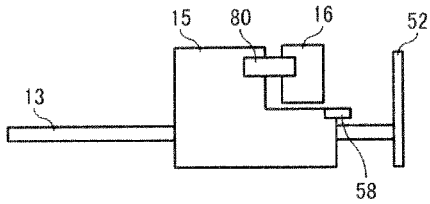
FIGS. 10A to 10G are front views respectively illustrating stages in the process of separating the second carriage from the first carriage.
Figure 10B:
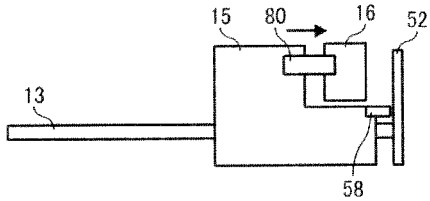
Figure 10C:
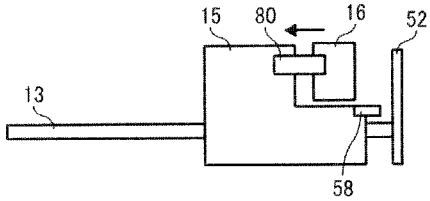
Figure 10D:
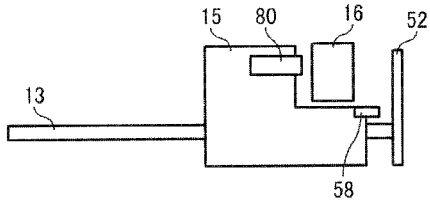
Figure 10E:
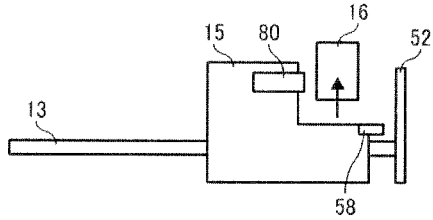
Figure 10F:
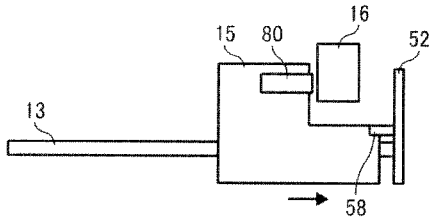
Figure 10G:
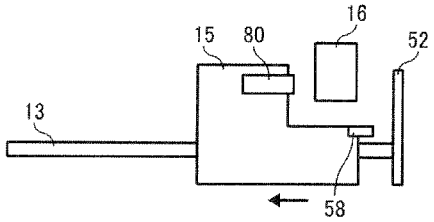

FIGS. 10A to 10G are front views respectively illustrating stages in the process of separating the second carriage 16 from the first carriage 15. When separation of the second carriage 16 from the first carriage 15 is requested under the state illustrated in FIG. 10A, the first carriage 15 is moved toward the lateral plate 52 and the protrusion 58 contacts the lateral plate 52 as illustrated in FIG. 10B to determine the reference position of the first carriage 15. Alternatively, the reference position of the first carriage 15 may be determined by the different methods described previously. Next, the first carriage 15 is moved to the separation position as illustrated in FIG. 10C, and the docking mechanism 80 is separated from the second carriage 16 as illustrated in FIG. 10D to separate the second carriage 16 from the first carriage 15. Next, the second carriage 16 is lifted as illustrated in FIG. 10E and the recording heads 102 of the second carriage 16 are capped with the caps 72. Thereafter, the reference position of the first carriage 15 is determined again as illustrated in FIG. 10F and the first carriage 15 is moved to the capping position as illustrated in FIG. 10G so that the recording heads 101 of the first carriage 15 are capped with the caps 71. It is to be noted that determination of the reference position of the first carriage 15 after the second carriage 16 is separated from the first carriage 15 may or may not be performed depending on the situation at that time.

Figure 11:
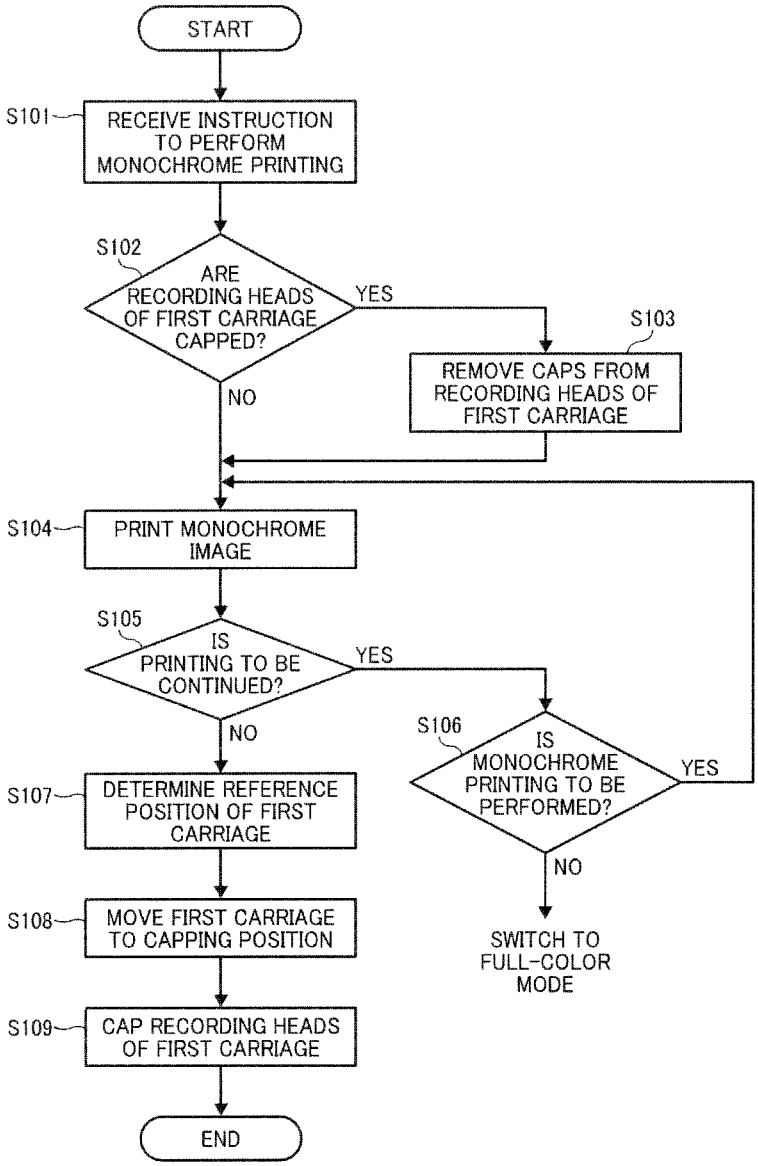
FIG. 11 is a flowchart illustrating steps in a process of monochrome printing using only the first carriage according to illustrative embodiments.

With reference to FIG. 11, a description is now given of monochrome printing performed using only the first carriage 15. FIG. 11 is a flowchart illustrating steps in a process of monochrome printing using only the first carriage 15 according to illustrative embodiments.

Upon receiving an instruction to perform monochrome printing at step S101, whether or not the recording heads 101 of the first carriage 15 are capped is determined at S102. When the recording heads 101 are capped (YES at S102), the process proceeds to S103 to remove the caps 71 from the recording heads 101, and then monochrome printing is performed at S104. When the recording heads 101 are not capped (NO at S102), the process proceeds directly to S104 to perform monochrome printing. At S105, whether or not printing is to be continued is confirmed. When printing is to be continued (YES at S105), the process proceeds to S106 to determine whether or not monochrome printing is to be performed. When monochrome printing is to be performed (YES at S106), the process returns to S104 to perform monochrome printing. When full-color printing is to be performed (NO at S106), a print mode is switched to a full-color mode to perform docking of the second carriage 16 with the first carriage 15 and so forth to be described in FIG. 12. By contrast, when printing is not to be continued (NO at S105), the process proceeds to S107 after printing is completed. At S107, the reference position of the first carriage 15 is determined. At S108 the first carriage 15 is moved to the capping position, so that the recording heads 101 of the first carriage 15 are capped with the caps 71 at S109 to complete the process.

Figure 12:
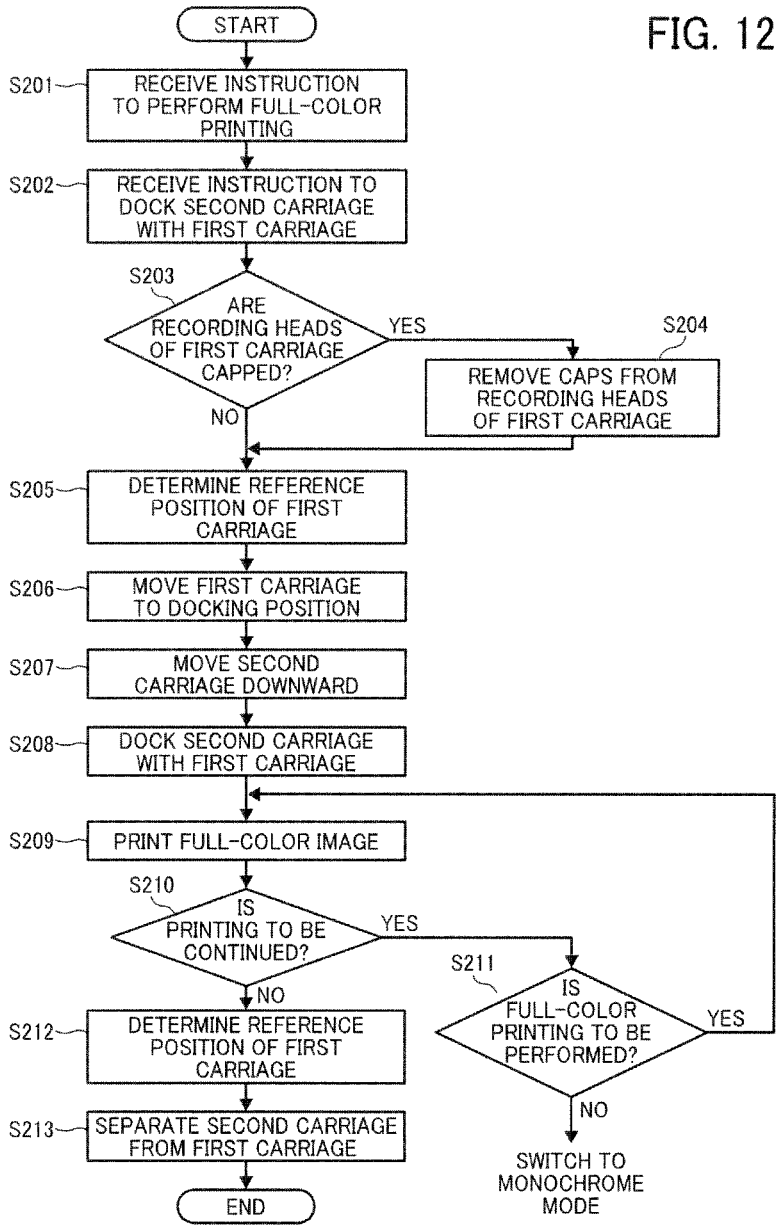
FIG. 12 is a flowchart illustrating steps in a process of full-color printing using both of the first and second carriages according to illustrative embodiments.

With reference to FIG. 12, a description is now given of full-color printing performed using both of the first and second carriages 15 and 16. FIG. 12 is a flowchart illustrating steps in a process of full-color printing using both of the first and second carriages 15 and 16 according to illustrative embodiments.

Upon receiving an instruction to perform full-color printing at step S201, at S202 an instruction to dock the second carriage 16 with the first carriage 15 is received. At S203, whether or not the recording heads 101 of the first carriage 15 are capped is confirmed. When the recording heads 101 of the first carriage 15 are capped with the caps 71 (YES at S203), the process proceeds to S204 to remove the caps 71 from the recording heads 101 of the first carriage 15, and then at S205, the reference position of the first carriage 15 is determined. When the recording heads 101 of the first carriage 15 are not capped (NO at S203), the process proceeds directly to S205 so that the reference position of the first carriage 15 is determined. At S206, the first carriage 15 is moved to the docking position. At S207, the caps 72 that cap the recording heads 102 of the second carriage 16 are lowered, and then the second carriage 16 is lowered. Alternatively, the caps 72 and the second carriage 16 may be lowered together. At S208, the second carriage 16 is placed on the mounts 55 of the first carriage 15 to be docked with the first carriage 15. Then, at S209 the first carriage 15 with which the second carriage 16 is docked is moved reciprocally to perform full-color printing. Thereafter, at S210 whether or not printing is to be continued is confirmed. When printing is to be continued (YES at S210), the process proceeds to S211 to determine whether or not full-color printing is to be performed. When monochrome printing is to be performed (NO at S211), the process proceeds to switch the print mode to the monochrome mode to separate the second carriage 16 from the first carriage 15 as illustrated in FIG. 9, and then monochrome printing is performed as illustrated in FIG. 11. When full-color printing is to be performed (YES at S211), the process returns to S209 to perform full-color printing. By contrast, when printing is not to be performed (NO at S210), the process proceeds to S212 to determine the reference position of the first carriage 15. At S213, the second carriage 16 is separated from the first carriage 15 as illustrated in FIG. 9, and at the same time, a home position of the first carriage 15 is detected.

Figure 13:
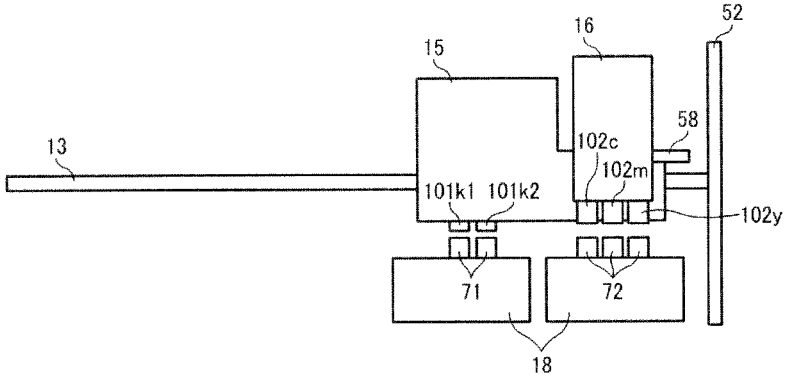
FIG. 13 is a schematic view illustrating a relation between a docking/separation position and a capping position of the first and second carriages according to illustrative embodiments.

With reference to FIG. 13, a description is now given of a relation between the docking/separation position and the capping position of the first and second carriages 15 and 16. FIG. 13 is a schematic view illustrating the relation between the docking/separation position and the capping position of the first and second carriages 15 and 16 according to illustrative embodiments.

As described previously, the capping position where the recording heads 102 of the second carriage 16 are capped with the caps 72 is determined based on the reference position of the first carriage 15. Accordingly, the second carriage 16 is accurately positioned at the capping position, thereby preventing a shift in the relative positions of the recording heads 102 of the second carriage 16 and the caps 72.

In addition, the separation position where the second carriage 16 is separated from the first carriage 15 is the same as the capping position where the recording heads 101 and 102 of the first and second carriages 15 and 16 are capped with the caps 71 and 72, respectively, in the main scanning direction.

Figure 14:
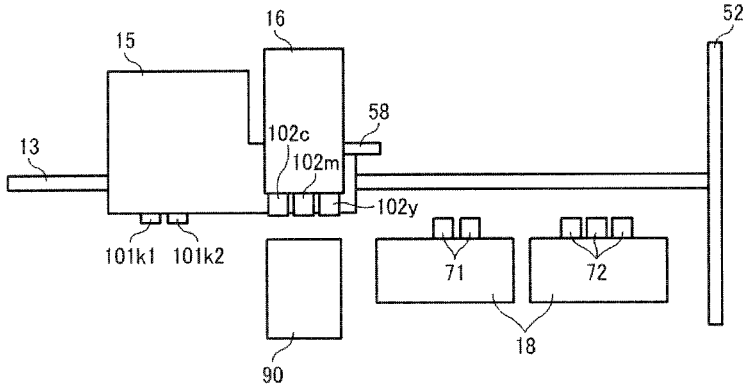
FIG. 14 is a schematic view illustrating determination of a position for detecting a status of ejection of color ink droplets from a recording head of the second carriage according to illustrative embodiments.

Determination of a position for detecting those nozzles through which color ink droplets are not properly ejected from the recording heads 102 of the second carriage 16 is described in detail below with reference to FIG. 14. FIG. 14 is a schematic view illustrating determination of a position for detecting a status of ejection of the color ink droplets from the recording heads 102 of the second carriage 16 according to illustrative embodiments.

Clogging of the nozzles of the recording heads 101 and 102 of the first and second carriages 15 and 16 can cause irregularities to appear in the output images. Therefore, the image forming apparatus 1 further includes a clogged nozzle detector 90 serving as an ejection status detector that detects irregular ejection of the ink droplets and a shift in a direction of ejection of the ink droplets due to clogging of the nozzles. A detection position where the clogged nozzle detector 90 detects the clogged nozzles is a position facing the first and second carriages 15 and 16 within the main scanning range of the first and second carriages 15 and 16 in the main scanning direction.

The detection position for detecting the clogged nozzles in the recording heads 102 of the second carriage 16 is determined based on the reference position of the first carriage 15. Accordingly, the detection position can be accurately determined, and a shift in the relative positions of the recording heads 102 and the clogged nozzle detector 90 can be prevented.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2009-278023, filed on Dec. 7, 2009 in the Japan Patent Office, which is hereby incorporated herein by reference in its entirety.

What is claimed is:

1. An image forming apparatus comprising:

a first carriage having a recording head that ejects black liquid droplets and is movable in a main scanning direction; and a second carriage having a recording head that ejects color liquid droplets, the second carriage being detachably attachable to the first carriage within a scanning range of the first carriage in the main scanning direction, wherein the first carriage has a mount to place the second carriage thereon, and the mount of the first carriage is disposed relative to the second carriage such that the second carriage is lowered toward the mount of the first carriage in a direction of ejection of the liquid droplets to attach the second carriage to the first carriage, and wherein the second carriage is attached to the first carriage during full-color printing, and the second carriage and the first carriage move in the main scanning direction together while attached to each other to perform full-color printing, an attachment and detachment position at which the first carriage and the second carriage are attached to, and detached from, each other is determined relative to a reference position of the first carriage in the main scanning direction, wherein the first carriage further comprises a protrusion that contacts a lateral plate disposed at one end of the scanning range of the first carriage in the main scanning direction to determine the reference position of the first carriage in the main scanning direction.

2. The image forming apparatus according to claim 1, wherein the protrusion protrudes toward the lateral plate beyond the second carriage placed on the mount when the second carriage is attached to the first carriage.

3. The image forming apparatus according to claim 1, further comprising a cap member that caps an ejection surface of the recording head of the second carriage, wherein a capping position of the second carriage at which the ejection surface of the second carriage is capped with the cap member is determined based on the reference position of the first carriage in the main scanning direction.

4. The image forming apparatus according to claim 3, wherein the attachment and detachment position at which the first carriage and the second carriage attach and detach is the same as the capping position of the second carriage in the main scanning direction.

5. The image forming apparatus according to claim 1, further comprising an ejection status detector that detects a status of ejection of the color liquid droplets from the recording head of the second carriage at a detection position determined based on the reference position of the first carriage in the main scanning direction.

6. The image forming apparatus according to claim 1, wherein the second carriage is lowered toward the mount of the first carriage in the direction of ejection of the liquid droplets to be placed on the mount of the first carriage.

* * * * *